US005901578A

United States Patent [19]

Wong et al.

[11] Patent Number: 5,901,578

[45] Date of Patent: May 11, 1999

[54] CRYOGENIC RECTIFICATION SYSTEM WITH INTEGRAL PRODUCT BOILER

[75] Inventors: Kenneth Kai Wong, Amherst; Michael James Lockett; Dante Patrick Bonaquist, both of Grand Island; Vijayaraghavan Srinivasan, Williamsville; John Keller Howell, Tonawanda, all of N.Y.

[73] Assignee: Praxair Technology, Inc., Danbury, Conn.

[21] Appl. No.: 09/080,305

[22] Filed: May 18, 1998

[51] Int. Cl.[6] ..... F25J 3/00

[52] U.S. Cl. ..... 62/646; 62/654

[58] Field of Search ..... 62/654, 646

[56] References Cited

U.S. PATENT DOCUMENTS

| | | | |
|---|---|---|---|
| 4,372,764 | 2/1983 | Theobald | 62/13 |
| 5,036,672 | 8/1991 | Rottmann | 62/654 |
| 5,365,741 | 11/1994 | Roberts et al. | 62/38 |
| 5,386,692 | 2/1995 | Laforce | 62/25 |
| 5,398,514 | 3/1995 | Roberts et al. | 62/38 |
| 5,456,083 | 10/1995 | Hogg et al. | 62/25 |
| 5,546,767 | 8/1996 | Dray et al. | 62/654 |
| 5,564,290 | 10/1996 | Bonaquist et al. | 62/646 |
| 5,600,970 | 2/1997 | Drnevich et al. | 62/651 |
| 5,628,207 | 5/1997 | Howard et al. | 62/654 |
| 5,655,388 | 8/1997 | Bonaquist et al. | 62/651 |
| 5,675,977 | 10/1997 | Prosser | 62/646 |

*Primary Examiner*—Ronald Capossela
*Attorney, Agent, or Firm*—Stanley Ktorides

[57] ABSTRACT

A cryogenic rectification system wherein a product boiler is incorporated into the primary heat exchanger without encountering boiling to dryness problems wherein liquid from the cryogenic rectification plant is processed in a phase separator upstream of the product boiler, and fluid from the product boiler is passed into the phase separator prior to recovery.

10 Claims, 2 Drawing Sheets

CRYOGENIC RECTIFICATION SYSTEM WITH INTEGRAL PRODUCT BOILER

TECHNICAL FIELD

This invention relates generally to cryogenic rectification of feed air and, more particularly, to cryogenic rectification of feed air to produce elevated pressure gaseous product.

BACKGROUND ART

In the cryogenic rectification of feed air to produce one or more products such as oxygen, often it is desired that product be recovered as elevated pressure gas. One way of achieving this is to operate the column or columns of the cryogenic air separation plant at elevated pressure and recover elevated pressure gaseous product directly from the distillation column. However, such a system is generally disadvantageous because the elevated pressure within the column burdens the separations. Preferably the final separation within a column is carried out at a relatively low pressure and, if elevated pressure gaseous product is desired, the product is withdrawn from the column and its pressure increased prior to recovery.

For the recovery of elevated pressure gaseous product, the product may be withdrawn from the column as gas and then compressed to the desired pressure. However, it is generally more preferable that the product be withdrawn from the column as liquid, pumped to the desired pressure, and then vaporized in a product boiler to produce the desired elevated pressure gas.

Typically the product boiler is a pool boiler heat exchanger which is separate from other heat exchangers of the system. This arrangement is very effective but is costly. It is desirable that the product boiler be integrated with the primary heat exchanger of the system and such arrangements are known. However, in some situations the integration of the product boiler with the primary heat exchanger may lead to a boiling to dryness problem wherein residual hydrocarbons may concentrate in oxygen creating a flammability issue and potential danger.

Accordingly, it is an object of this invention to provide a cryogenic rectification system for producing elevated pressure gaseous product employing a product boiler integrated with the primary heat exchanger which enables avoidance of any hazard due to boiling to dryness.

SUMMARY OF THE INVENTION

The above and other objects, which will become apparent to those skilled in the art upon a reading of this disclosure, are attained by the present invention, one aspect of which is:

A cryogenic rectification method for producing gaseous product comprising:

(A) cooling feed air in a primary heat exchanger and passing the cooled feed air into a cryogenic air separation plant;

(B) separating the feed air within the cryogenic air separation plant by cryogenic rectification to produce vapor and liquid;

(C) passing liquid from the cryogenic air separation plant to a phase separator and passing liquid from the phase separator to the primary heat exchanger;

(D) partially vaporizing the liquid in the primary heat exchanger by indirect heat exchange with the cooling feed air, and passing the resulting fluid back to the phase separator; and (E) recovering vapor from the phase separator as gaseous product.

Another aspect of the invention is:

Apparatus for producing gaseous product by cryogenic rectification comprising:

(A) a primary heat exchanger and means for passing feed air to the primary heat exchanger;

(B) a cryogenic air separation plant comprising at least one column, and means for passing feed air from the primary heat exchanger to the cryogenic air separation plant;

(C) a phase separator and means for passing fluid from the cryogenic air separation plant to the phase separator;

(D) means for passing fluid from the phase separator to the primary heat exchanger and from the primary heat exchanger to the phase separator; and (E) means for recovering gaseous product from the phase separator.

As used herein, the term "product boiler" means a heat exchanger wherein liquid from a cryogenic air separation plant, typically at increased pressure, is vaporized by indirect heat exchange with feed air. In the practice of this invention, the product boiler comprises a part of the primary heat exchanger.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

The term "double column", is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the terms "upper portion" and "lower portion" mean those sections of a column respectively above and below the mid point of the column.

As used herein, the term "indirect heat exchange" means the bringing of two fluids into heat exchange relation without any physical contact or intermixing of the fluids with each other.

As used herein, the term "primary heat exchanger" means the main heat exchanger associated with a cryogenic air separation process wherein the feed air is cooled from ambient temperature to cold temperatures associated with the distillation by indirect heat exchange with return streams. The primary heat exchanger can also include subcooling column liquid streams and/or vaporizing productliquid streams.

As used herein, the term "phase separator" means a vessel with sufficient cross-sectional area so that an entering two phase fluid can be separated by gravity into separate gas and liquid components which can then be separately removed from the phase separator vessel.

DETAILED DESCRIPTION

Figure 1:
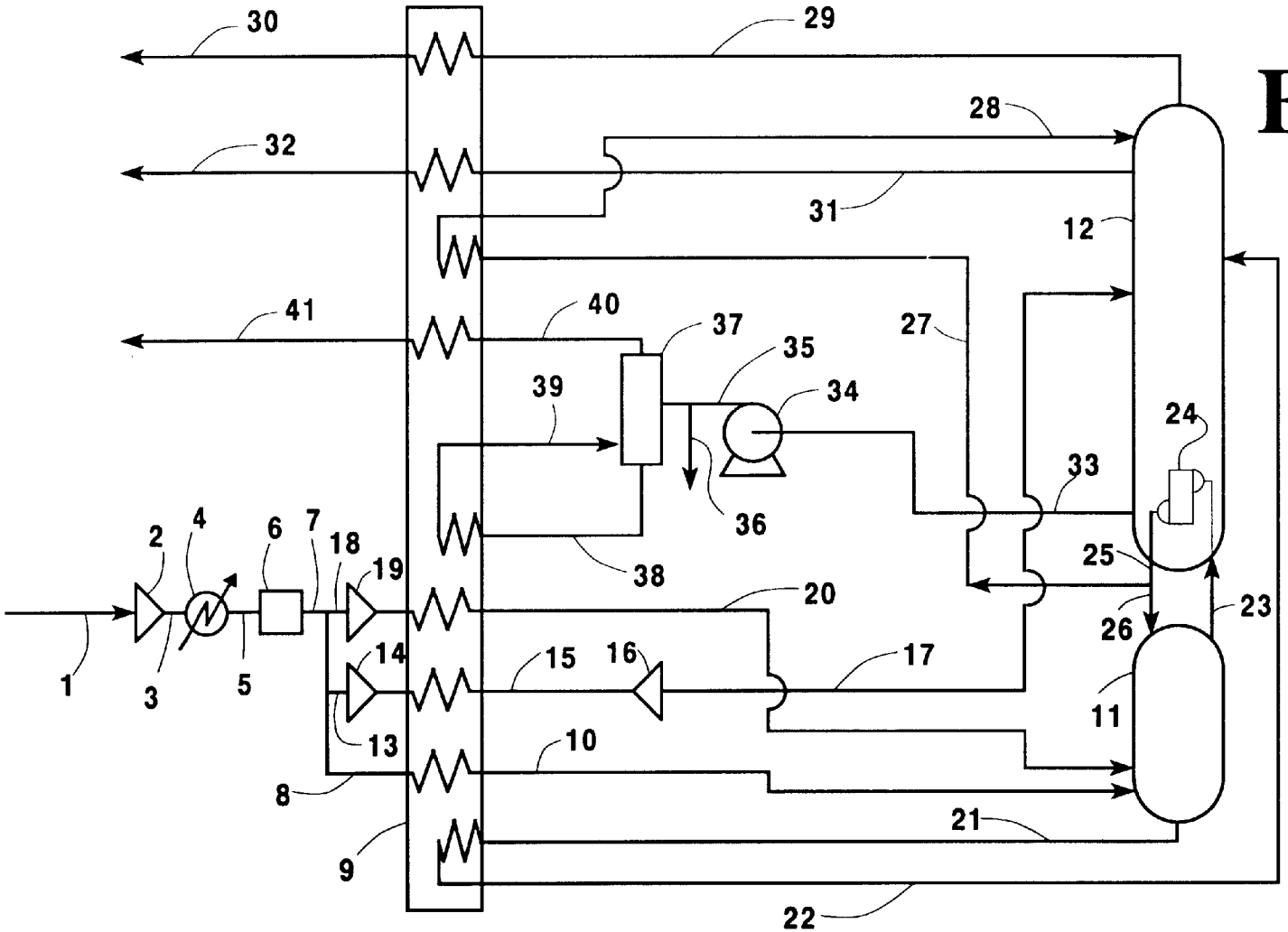
FIG. 1 is a simplified schematic representation of one preferred embodiment of the invention wherein the cryogenic air separation plant comprises a double column and the phase separator is housed separately from the primary heat exchanger.

The invention will be described in detail with reference to the Drawings. Referring now to FIG. 1, feed air 1 is compressed by passage through base load air compressor 2 and compressed feed air 3 is cooled of the heat of compression by passage through cooler 4. Resulting feed air 5 is cleaned of high boiling impurities such as water vapor, carbon dioxide and hydrocarbons by passage through prepurifier 6 to provide prepurified feed air 7.

In the embodiment of the invention illustrated in FIG. 1, prepurified feed air 7 is divided into three portions. One portion 8 is cooled by passage through primary heat exchanger 9 and resulting cooled feed air stream 10 is passed into first or higher pressure column 11 of the cryogenic air separation plant which also comprises second or lower pressure column 12. Another portion 13 of prepurified feed air 7 is compressed to a higher pressure by passage through compressor 14 and then cooled by passage through primary heat exchanger 9. Resulting cooled feed air stream 15 is turboexpanded by passage through turboexpander 16 to generate refrigeration and resulting turboexpanded feed air stream 17 is passed into lower pressure column 12. Another portion 18 of prepurified feed air 7 is compressed to a higher pressure by passage through compressor 19 and then cooled and preferably at least partially condensed by passage through primary heat exchanger 9. Resulting feed air stream 20 is then passed into higher pressure column 11.

Higher pressure column 11 is operating at a pressure generally within the range of from 65 to 90 pounds per square inch absolute (psia). Within higher pressure column 11 the feed air is separated by cryogenic rectification into nitrogen-enriched vapor and oxygen-enriched liquid. Oxygen-enriched liquid is withdrawn from the lower portion of higher pressure column 11 in stream 21, subcooled by passage through primary heat exchanger 9, and then passed as stream 22 into lower pressure column 12. Nitrogen-enriched vapor is withdrawn from the upper portion of higher pressure column 11 in stream 23 and passed into main condenser 24 wherein it is condensed by indirect heat exchange with boiling column 12 bottom liquid. Resulting nitrogen-enriched liquid 25 is divided into portion 26, which is returned to higher pressure column 11 as reflux, and into portion 27, which is subcooled by passage through primary heat exchanger 9 and then passed as stream 28 into the upper portion of lower pressure column 12 as reflux.

Lower pressure column 12 is operating at a pressure less than that of higher pressure column 11 and generally within the range of from 19 to 30 psia. Within lower pressure column 12 the various feeds into that column are separated by cryogenic rectification into nitrogen-rich vapor and oxygen-rich liquid. Nitrogen-rich vapor is withdrawn from the upper portion of lower pressure column 12 in stream 29, warmed by passage through primary heat exchanger 9, and passed out of the system as nitrogen gas stream 30 which may be recovered in whole or in part as product nitrogen having a nitrogen concentration of at least 99 mole percent. For product purity control purposes a waste stream 31 is withdrawn from the upper portion of lower pressure column 12 below the withdrawal level of stream 29, warmed by passage through primary heat exchanger 9, and withdrawn from the system in stream 32.

Oxygen-rich liquid, having an oxygen concentration of at least 85 mole percent and generally within the range of from 95 to 99.8 mole percent, is withdrawn from the lower portion of lower pressure column 12 in stream 33. Preferably, as illustrated in FIG. 1, oxygen-rich liquid is pumped to a higher pressure by passage through liquid pump 34 to produce pressurized oxygen-rich liquid stream 35. The invention has particular utility when the pressure of the liquid provided to the product boiler is within the range of from 15 to 55 psia. If desired, a portion 36 of pumped oxygen-rich liquid 35 may be recovered as product liquid oxygen.

Oxygen-rich liquid 35 is passed into phase separator 37 and liquid from phase separator 37 is passed in stream 38 into the product boiler section of primary heat exchanger 9 wherein it is partially vaporized by indirect heat exchange with the cooling feed air. The flow of oxygen-rich liquid in stream 38 is controlled to ensure the requisite partial vaporization of the liquid in the product boiler section. Resulting two-phase fluid 39 is passed back to phase separator 37 from the product boiler and vapor 40 is withdrawn from phase separator 37 and recovered as gaseous oxygen product having an oxygen concentration of at least 85 mole percent. Preferably, as illustrated in FIG. 1, gaseous oxygen stream 40 is warmed by passage through primary heat exchanger 9 prior to recovery as stream 41. Use of the phase separator avoids complete vaporization of the liquid within the heat exchanger and thereby avoids the boiling to dryness condition that could concentrate hydrocarbons in the enriched liquid oxygen and constitute a hazardous condition.

The embodiment of the invention illustrated in FIG. 1 has the phase separator housed separately from the product boiler section of the primary heat exchanger. It may be preferable that the phase separator be housed together with the product boiler and one such embodiment is illustrated in FIG. 2.

Figure 2:
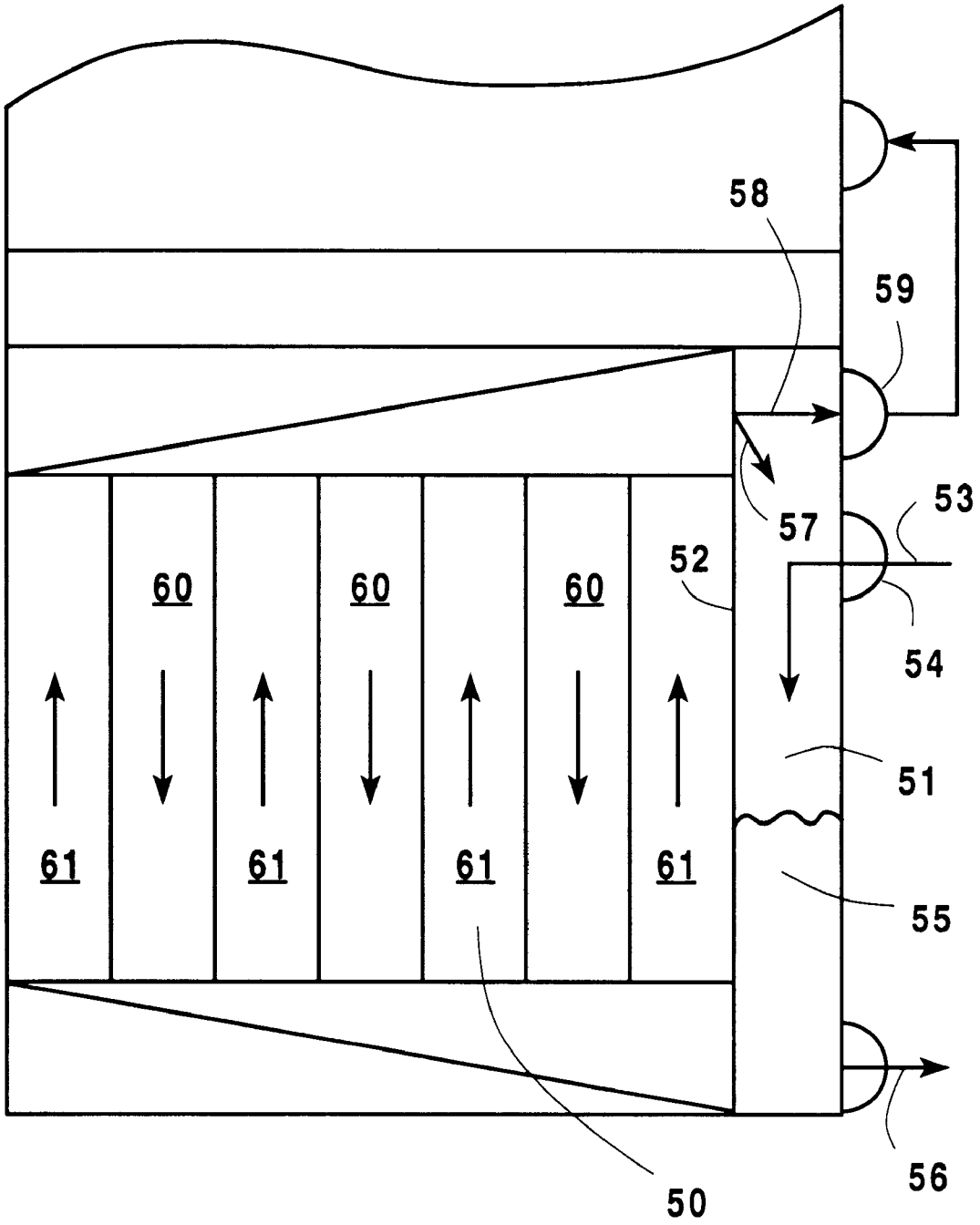
FIG. 2 is a cross sectional representation of one preferred embodiment of the integral product boiler useful with the invention wherein the phase separator is housed together with the primary heat exchanger.

Referring now to FIG. 2, there is shown product boiler section 50 housed together with phase separator 51 with vertical spacer bar 52 therebetween. The embodiment as illustrated in FIG. 2 would constitute the lower portion of the primary heat exchanger and is shown in cross-section. As is well known in the heat exchanger art, the boiling passages 61 and the cooling passages 60 are formed by stacking plates and fin stock in an alternating fashion and utilizing associated separator bars and distributors to introduce and collect the fluids from the individual passages. Liquid 53 from the cryogenic air separation plant is passed into phase separator 51 through inlet 54 and forms liquid pool 55 within phase separator 51. If desired, liquid may be recovered from phase separator 51 in liquid product stream 56.

Liquid from liquid pool 55 is passed into the bottom of the heat exchange passages 61 of product boiler 50 and up these heat exchange passages due to the liquid head pressure of pool 55. Within these heat exchange passages the upflowing liquid is partially vaporized by indirect heat exchange with downflowing cooling feed air in passages 60. Resulting two-phase fluid is passed out of the top of the heat exchange passages and back into phase separator 51. The liquid 57 of the two-phase fluid falls into and becomes part of liquid pool 55, while the vapor 58 of the two-phase fluid is passed out of phase separator 51 through outlet 59 for recovery as product gas. In the embodiment illustrated in FIG. 2, the product gas is warmed by passage through the primary heat exchanger prior to recovery. Although the product boiler section 50 is generally located at the bottom of the primary heat exchanger 9, it should be understood that the feed air cooling passages 60 can extend throughout the entire length of the primary heat exchanger. The feed air cooling stream 20 is first cooled versus return streams in the upper portion of the primary heat exchanger and then further cooled and condensed in the lower portion, i.e. the product boiler section, of the primary heat exchanger.

Although the invention has been described in detail with reference to certain preferred embodiments, those skilled in the art will recognize that there are other embodiments of the invention within the spirit and the scope of the claims. For example, other cryogenic air separation plants, such as a plant having a double column with an argon sidearm column and/or an upstream side column, may be employed.

We claim:

1. A cryogenic rectification method for producing gaseous product comprising:

(A) cooling feed air in a primary heat exchanger and passing the cooled feed air into a cryogenic air separation plant;

(B) separating the feed air within the cryogenic air separation plant by cryogenic rectification to produce vapor and liquid;

(C) passing liquid from the cryogenic air separation plant to a phase separator and passing liquid from the phase separator to the primary heat exchanger;

(D) partially vaporizing the liquid in the primary heat exchanger by indirect heat exchange with the cooling feed air, and passing the resulting fluid back to the phase separator; and (E) recovering vapor from the phase separator as gaseous product.

2. The method of claim 1 wherein the liquid is oxygen-rich liquid having an oxygen concentration of at least 85 mole percent.

3. The method of claim 1 wherein the liquid is increased in pressure prior to passage to the phase separator.

4. The method of claim 1 wherein the vapor from the phase separator is warmed by indirect heat exchange with cooling feed air prior to recovery.

5. Apparatus for producing gaseous product by cryogenic rectification comprising:

(A) a primary heat exchanger and means for passing feed air to the primary heat exchanger;

(B) a cryogenic air separation plant comprising at least one column, and means for passing feed air from the primary heat exchanger to the cryogenic air separation plant;

(C) a phase separator and means for passing fluid from the cryogenic air separation plant to the phase separator;

(D) means for passing fluid from the phase separator to the primary heat exchanger and from the primary heat exchanger to the phase separator; and (E) means for recovering gaseous product from the phase separator.

6. The apparatus of claim 5 wherein the phase separator is housed separately from the primary heat exchanger.

7. The apparatus of claim 5 wherein the phase separator is housed together with the primary heat exchanger.

8. The apparatus of claim 5 wherein the cryogenic air separation plant comprises a double column having a higher pressure column and a lower pressure column, and the means for passing fluid from the cryogenic air separation plant to the phase separator communicates with the lower portion of the lower pressure column.

9. The apparatus of claim 5 wherein the means for passing fluid from the cryogenic air separation plant to the phase separator includes a liquid pump.

10. The apparatus of claim 5 wherein the means for recovering gaseous product from the phase separator includes means for passing vapor from the phase separator through the primary heat exchanger.

* * * * *